US012589923B2

(12) United States Patent
Li

(10) Patent No.: US 12,589,923 B2
(45) Date of Patent: Mar. 31, 2026

(54) MAGNETIC SUCTION STRUCTURE OF VACUUM CUP

(71) Applicant: XIAMEN WORTHFIND CO, LTD., Fujian (CN)

(72) Inventor: Jiasong Li, Fujian (CN)

(73) Assignee: XIAMEN WORTHFIND CO, LTD., Fujian (CN)

( * ) Notice: Subject to any disclaimer, the term of this patent is extended or adjusted under 35 U.S.C. 154(b) by 71 days.

(21) Appl. No.: 18/368,568

(22) Filed: Sep. 15, 2023

(65) Prior Publication Data

US 2024/0002112 A1 Jan. 4, 2024

(51) Int. Cl.
*B65D 47/08* (2006.01)

(52) U.S. Cl.
CPC ..... *B65D 47/0857* (2013.01); *B65D 2313/04* (2013.01); *B65D 2547/06* (2013.01)

(58) Field of Classification Search
CPC ..... B65D 47/0857; B65D 2313/04; B65D 2547/06; A47J 41/0022
See application file for complete search history.

(56) References Cited

U.S. PATENT DOCUMENTS 8,651,306 B2 * 2/2014 Pai ..... B65D 47/32 222/189.09
11,912,470 B2 * 2/2024 Jacob ..... A45F 3/18
2018/0194518 A1 * 7/2018 Li ..... B65D 23/12

* cited by examiner

*Primary Examiner* — Donnell A Long
(74) *Attorney, Agent, or Firm* — Birchwood IP

(57) ABSTRACT

A magnetic suction structure of a vacuum cup, having a mounting piece, a pivot piece and a cup lid; the vacuum cup has a water outlet; the mounting piece is mounted on a periphery of the water outlet; the pivot piece is rotatably connected with the mounting piece; the pivot piece has a through hole; when the pivot piece is rotated to close against the mounting piece to achieve a close state, the through hole sleeves the water outlet; when the pivot piece is rotated away from the mounting piece to achieve an open state, the pivot piece and the mounting piece are magnetically engaged; the cup lid is rotatably mounted in the through hole and in threaded connection with the water outlet. The vacuum cup ensures good sealing effect, prevents the cup lid from falling down, and thus enhances user's experience.

9 Claims, 5 Drawing Sheets

MAGNETIC SUCTION STRUCTURE OF VACUUM CUP

BACKGROUND OF THE INVENTION

The present invention relates to the technical field of vacuum cups, in particular to a magnetic suction structure of a vacuum cup.

Conventional vacuum cups typically employ a threaded connection between the lid and the body. During use, the lid needs to be unscrewed. Generally, after the lid is removed, the user either holds the lid by hand or places it aside before drinking. However, holding the lid by hand can lead to inconvenience in drinking, and placing the lid aside can result in contamination or even lost of the lid.

Therefore, a lid of a flip type is introduced in subsequent improvement in the industry, allowing users to drink water from the vacuum cup by simply flipping up the lid. However, a lid of a flip type has the following two disadvantages during use: (1) When a user tilts the vacuum cup at a certain angle for drinking, the lid may easily flip downwards and collide with the tip of the nose, thus hindering drinking and causing a poor user's experience; and (2) since a flip lid should have a structure easy to flip open and easy to close, a contact between the lid and the cup opening is usually loose, and hence leading to a poor sealing effect.

BRIEF SUMMARY OF THE INVENTION

It is an object of the present invention to provide a magnetic suction structure of a vacuum cup to address the problems in the prior art. The magnetic suction structure can improve the sealing performance of a flip lid structure and also ensure that the lid will not easily fall down once flipped up, thus improving the user's experience.

To fulfill the above object, the present invention provides the following technical solutions:

A magnetic suction structure of a vacuum cup, comprising said vacuum cup, a mounting piece, a pivot piece and a cup lid; the vacuum cup is provided with a water outlet; the mounting piece is mounted on a periphery of the water outlet; the pivot piece is rotatably connected with the mounting piece; the pivot piece is provided with a through hole; when the pivot piece is rotated to close against the mounting piece to achieve a close state, the through hole sleeves the water outlet; when the pivot piece is rotated away from the mounting piece to achieve an open state, the pivot piece and the mounting piece are magnetically engaged; the cup lid is rotatably mounted in the through hole; and the cup lid is in threaded connection with the water outlet.

The mounting piece is provided with a pivot shaft; both sides of one end of the pivot piece are provided with connecting lugs respectively, and the connecting lugs are coaxially connected with the pivot shaft.

Upper surfaces of the mounting piece and the pivot piece are embedded with a first magnet and a second magnet respectively; when the pivot piece is rotated away from the mounting piece to achieve the open state, the first magnet faces to the second magnet; and the first magnet and the second magnet are magnetically engaged to each other.

A top side of the vacuum cup is provided with a protruded mouthpiece, and the water outlet extends through the mouthpiece in an axial direction of the mouthpiece; an inner side of the cup lid is provided with a stud, and external threads are formed on a peripheral surface of the stud, so that the stud is threaded to an inner wall of the water outlet.

The periphery of the water outlet is provided with a platform, and the mounting piece is detachably connected to a side wall of the platform.

Preferably, a mounting hole corresponding to the side wall of the platform is formed on the mounting piece, and at least one limiting groove is formed on an inner side wall of the mounting hole; the side wall of the platform is provided with at least one limiting block corresponding to said at least one limiting groove; the limiting block is embedded in the limiting groove.

Preferably, upper and lower edges of the limiting block are both rounded.

An annular limiting flange is formed on an inner side wall of the through hole; a limiting ring groove is formed on a peripheral surface of a lower end of the cup lid; the limiting flange is embedded in the limiting ring groove.

Preferably, an annular guiding inclined plane is formed on an outer edge of a bottom end surface of the cup lid.

A plurality of anti-skidding lined patterns are formed on an outer peripheral surface of the cup lid along an axial direction of the cup lid.

The above technical solutions achieve the following technical effects:

1) The cup lid of the present invention is assembled to the periphery of the water outlet through the pivot piece which is rotatably connected with the mounting piece; when the pivot piece is flipped up and back along with the cup lid, the cup lid can be magnetically fixed in positioned through magnetic engagement between the mounting piece and the pivot piece, so that the cup lid is kept in an open state and will not fall down, failing which may otherwise collide with the tip of the nose and hinder drinking of water from the vacuum cup. Therefore, user's experience is greatly optimized.

2) The cup lid is rotatably engaged with the pivot piece and can rotate relative to the pivot piece, so that the cup lid can be threaded to the water outlet when the pivot piece is in the closed state, thus ensuring the sealing performance of the water outlet and preventing water leakage.

DETAILED DESCRIPTION OF THE INVENTION

Figure 1:
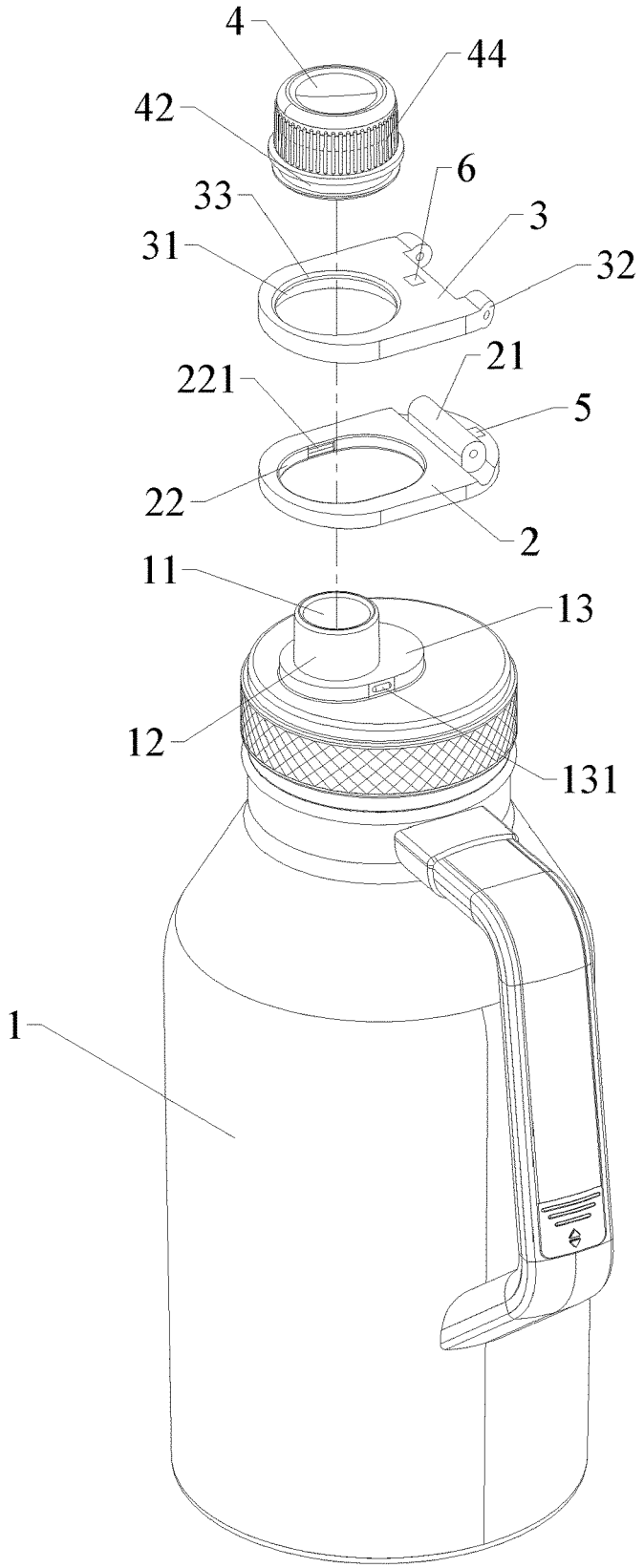
FIG. 1 is an exploded view of a specific embodiment of the present invention.
Figure 2:
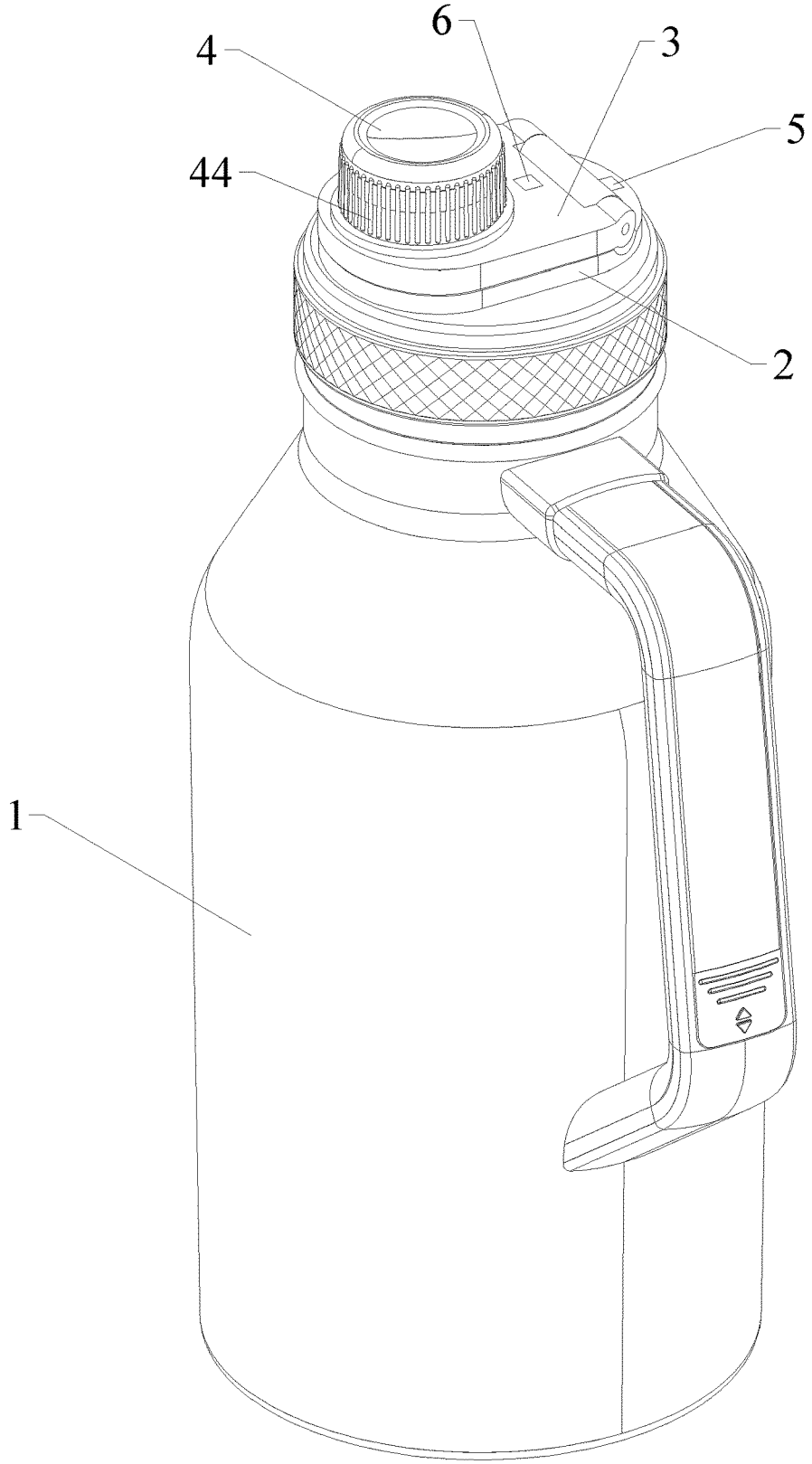
FIG. 2 is a perspective view of a closed state of a specific embodiment of the present invention.
Figure 3:
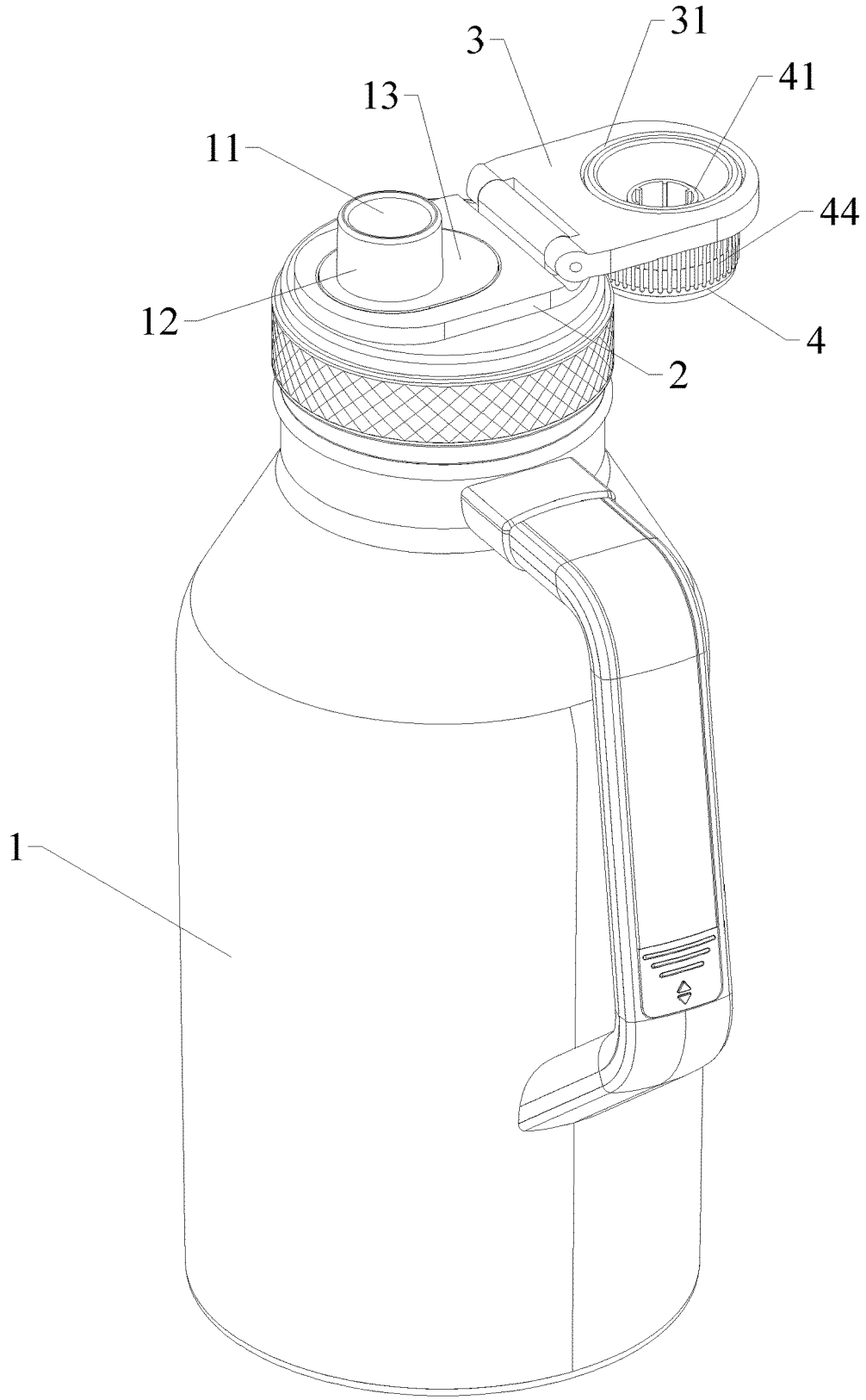
FIG. 3 is a perspective view of an open state of a specific embodiment of the present invention.
Figure 4:
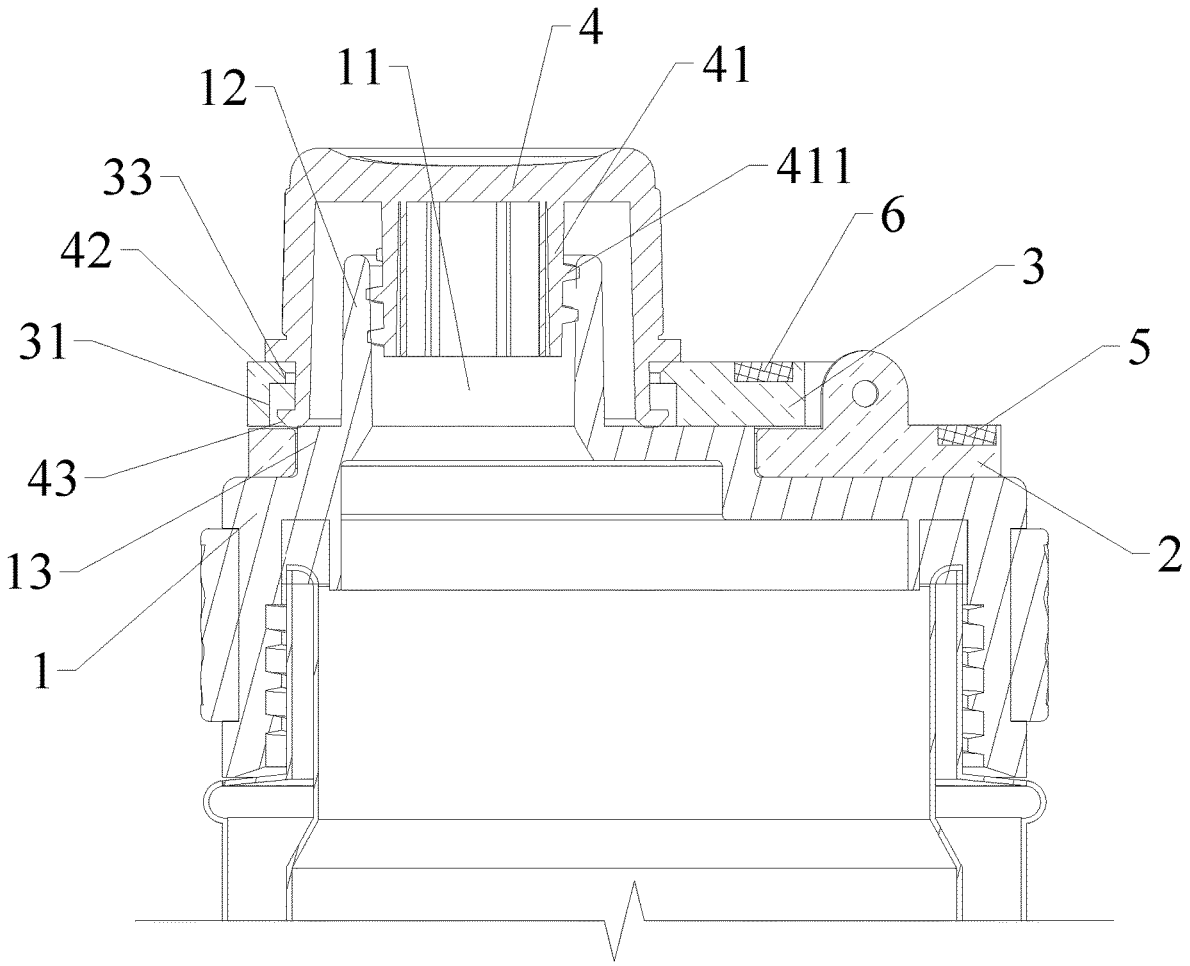
FIG. 4 is a cross-sectional view of some structural elements of a specific embodiment of the present invention in a close state.
Figure 5:
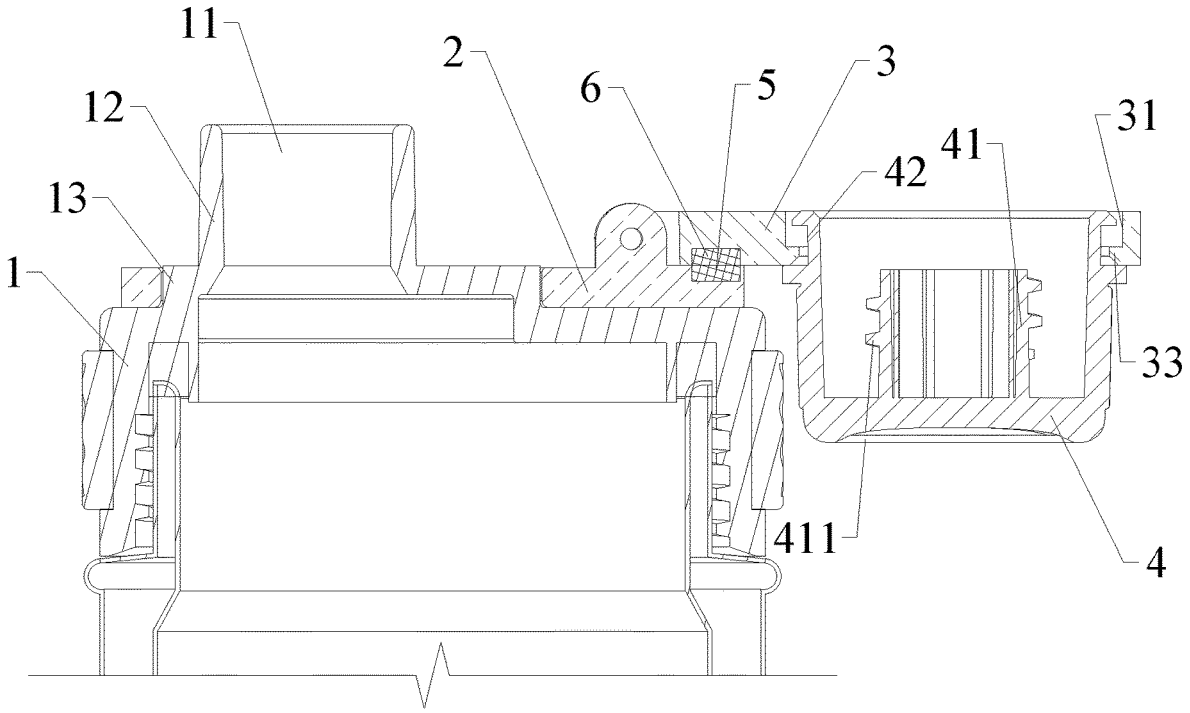
FIG. 5 is a cross-sectional view of some structural elements of a specific embodiment of the present invention in an open state.

Referring to FIGS. 1 to 5, the present invention discloses a magnetic suction structure of a vacuum cup, which comprises a vacuum cup 1, a mounting piece 2, a pivot piece 3 and a cup lid 4;

the vacuum cup 1 is provided with a water outlet 11;

the mounting piece 2 is mounted on a periphery of the water outlet 11;

the pivot piece 3 is rotatably connected with the mounting piece 2; the pivot piece 3 is provided with a through hole 31; when the pivot piece 3 is rotated to close against the mounting piece 2 to achieve a close state (see FIGS. 2 and 4), the through hole 31 sleeves the water outlet 11; when the pivot piece 3 is rotated away from the mounting piece 2 to achieve an open state (see FIGS. 3 and 5), the pivot piece 3 and the mounting piece 2 are magnetically engaged;

the cup lid 4 is rotatably mounted in the through hole 31; and the cup lid 4 is in threaded connection with the water outlet 11.

Specific embodiments of the present invention are shown below.

The mounting piece 2 is provided with a pivot shaft 21, and both sides of one end of the pivot piece 3 are provided with connecting lugs 32 respectively, and the connecting lugs are coaxially connected with the pivot shaft 21; the pivot piece 3 is rotatable around a rotating axis which is defined by a co-axis of the pivot shaft 21 and the connecting lugs 32, so that the pivot piece 3 is rotatable with respect to the mounting piece 2 between the close state and the open state.

Upper surfaces of the mounting piece 2 and the pivot piece 3 are embedded with a first magnet 5 and a second magnet 6 respectively; when the pivot piece 3 is rotated away from the mounting piece to achieve the open state, the first magnet 5 faces to the second magnet 6 and are magnetically engaged to each other, so that the cup lid 4 on the pivot piece 3 is fixed at a position about 180 degrees relative to the water outlet 11 and will not fall down when user tilts the vacuum cup to drink the water inside.

A top side of the vacuum cup 1 is provided with a protruded mouthpiece 12, and the water outlet 11 extends through the mouthpiece 12 in an axial direction of the mouthpiece 12; an inner side of the cup lid 4 is provided with a stud 41, and external threads 411 are formed on a peripheral surface of the stud 41, so that the stud 41 is threaded to an inner wall of the water outlet 11 to removably seal the water outlet 11. When the cup lid 4 is closed and screwed tightly, water leakage is avoided.

The periphery of the water outlet 11 is provided with a platform 13, and the mounting piece 2 is detachably connected to a side wall of the platform 13, so that the mounting piece 2 is mounted on the periphery of the water outlet 11.

Furthermore, a mounting hole 22 corresponding to the side wall of the platform 13 is formed on the mounting piece 2, and at least one limiting groove 221 is formed on an inner side wall of the mounting hole 22; the side wall of the platform 13 is provided with at least one limiting block 131 corresponding to said at least one limiting groove 221; the limiting block 131 is embedded in the limiting groove 221, so that the mounting piece 2 is detachably connected to the side wall of the platform 13. This allows users to remove the mounting piece 2 along with the pivot piece 3 and the cup lid 4 when needed. In this embodiment, both the platform 13 and the mounting hole 22 have an oblong circular shape resembling a running track of an athletic field, that is, a shape having two parallel straight lines where two pairs of corresponding ends of the two straight lines are connected by two arcs respectively. At least one pair of corresponding limiting block 131 and limiting groove 221 is provided on corresponding straight lines of the oblong circular shaped platform 13 and the oblong circular shaped mounting hole 22 respectively.

Besides, upper and lower edges of the limiting block 131 are both rounded, so that the edges of the limiting block 131 are smoother and thereby facilitating the assembly and disassembly of the mounting piece 2.

An annular limiting flange 33 is formed on an inner side wall of the through hole 31; a limiting ring groove 42 is formed on a peripheral surface of a lower end of the cup lid 4; the limiting flange 33 is embedded in the limiting ring groove 42, so that the cup lid 4 is axially limited on the pivot piece 3. This ensures that the cup lid 4 cannot fall off from the pivot piece 3 and can rotate in a circumferential direction relative to the through hole 31 so that the cup lid 4 can be threaded to the water outlet 11.

Furthermore, an annular guiding inclined plane 43 is formed on an outer edge of a bottom end surface of the cup lid 4, so that the cup lid 4 is easier to be assembled in the through hole 31, and assembly efficiency is enhanced.

A plurality of anti-skidding lined patterns 44 are formed on an outer peripheral surface of the cup lid 4 along an axial direction of the cup lid 4, thereby increasing the friction between the user's fingers and the cup lid 4 upon contact and making it easier to twist the cup lid 4.

Through the above technical solutions, the cup lid 4 of the present invention is assembled to the periphery of the water outlet 11 through the pivot piece 3 which is rotatably connected with the mounting piece 2; when the pivot piece 3 is flipped up and back along with the cup lid 4, the cup lid 4 can be magnetically fixed in positioned through magnetic engagement between the mounting piece 2 and the pivot piece 3, so that the cup lid 4 is kept in an open state and will not fall down, failing which may otherwise collide with the tip of the nose and hinder drinking of water from the vacuum cup. Therefore, user's experience is greatly optimized. Further, the cup lid 4 is rotatably engaged with the pivot piece 3 and can rotate relative to the pivot piece 3, so that the cup lid 4 can be threaded to the water outlet 11 when the pivot piece 3 is in the closed state, thus ensuring the sealing performance of the water outlet 11 and preventing water leakage.

What is claimed is:

1. A magnetic suction structure of a vacuum cup, comprising:

said vacuum cup, a mounting piece, a pivot piece and a cup lid;

the vacuum cup is provided with a water outlet;

the mounting piece is mounted on a periphery of the water outlet;

the pivot piece is rotatably connected with the mounting piece; the pivot piece is provided with a through hole; when the pivot piece is rotated to close against the mounting piece to achieve a close state, the through hole sleeves the water outlet; when the pivot piece is rotated away from the mounting piece to achieve an open state, the pivot piece and the mounting piece are magnetically engaged;

the cup lid is rotatably mounted in the through hole; and the cup lid is in threaded connection with the water outlet; the periphery of the water outlet is provided with a platform, and the mounting piece is detachably connected to a side wall of the platform.

2. The magnetic suction structure of the vacuum cup of claim 1, wherein the mounting piece is provided with a pivot shaft; both sides of one end of the pivot piece are provided with connecting lugs respectively, and the connecting lugs are coaxially connected with the pivot shaft.

3. The magnetic suction structure of the vacuum cup of claim 1, wherein upper surfaces of the mounting piece and the pivot piece are embedded with a first magnet and a second magnet respectively; when the pivot piece is rotated away from the mounting piece to achieve the open state, the first magnet faces to the second magnet, and the first magnet and the second magnet are magnetically engaged to each other.

4. The magnetic suction structure of the vacuum cup of claim 1, wherein a top side of the vacuum cup is provided with a protruded mouthpiece, and the water outlet extends through the mouthpiece in an axial direction of the mouthpiece; an inner side of the cup lid is provided with a stud, and external threads are formed on a peripheral surface of the stud, so that the stud is threaded to an inner wall of the water outlet.

5. The magnetic suction structure of the vacuum cup of claim 1, wherein a mounting hole corresponding to the side wall of the platform is formed on the mounting piece, and at least one limiting groove is formed on an inner side wall of the mounting hole; the side wall of the platform is provided with at least one limiting block corresponding to said at least one limiting groove; the limiting block is embedded in the limiting groove.

6. The magnetic suction structure of the vacuum cup of claim 5, wherein upper and lower edges of the limiting block are both rounded.

7. The magnetic suction structure of the vacuum cup of claim 1, wherein an annular limiting flange is formed on an inner side wall of the through hole; a limiting ring groove is formed on a peripheral surface of a lower end of the cup lid; the limiting flange is embedded in the limiting ring groove.

8. The magnetic suction structure of the vacuum cup of claim 7, wherein an annular guiding inclined plane is formed on an outer edge of a bottom end surface of the cup lid.

9. The magnetic suction structure of the vacuum cup of claim 1, wherein a plurality of anti-skidding lined patterns are formed on an outer peripheral surface of the cup lid along an axial direction of the cup lid.

* * * * *